US005388295A

United States Patent [19]

Sarkozi

[11] Patent Number: 5,388,295

[45] Date of Patent: Feb. 14, 1995

[54] ADJUSTABLE SEAT AND BACK SUPPORT PAD, AND MATTRESS

[76] Inventor: Jeff Sarkozi, 13722 Belle Rive, Santa Ana, Calif. 92705

[21] Appl. No.: 111,857

[22] Filed: Aug. 26, 1993

[51] Int. Cl.[6] ..... A47C 20/00

[52] U.S. Cl. ..... 5/630; 5/420; 5/465; 5/653

[58] Field of Search ..... 5/420, 653, 654, 630, 5/632, 465, 481, 903, 909

[56] References Cited

U.S. PATENT DOCUMENTS

| | | | |
|---|---|---|---|
| 2,184,808 | 12/1989 | Belian | 5/468 X |
| 2,731,652 | 1/1956 | Bishop | 5/903 |
| 3,293,671 | 12/1966 | Griffin | 5/481 |
| 4,394,783 | 7/1983 | Simmons | 5/653 X |
| 4,788,730 | 12/1988 | Bexton | 5/909 X |
| 4,824,411 | 4/1989 | McClanahan | 5/465 X |
| 4,843,666 | 7/1989 | Elesh et al. | 5/464 X |

*Primary Examiner*—Michael F. Trettel
*Attorney, Agent, or Firm*—Willie Krawitz

[57] ABSTRACT

An adjustable pad is provided, having particular utility as a seating and/or recliner support with chairs, seats such as car seats, or as a mattress construction. The pad comprises an array of individual, resilient, spaced-apart, longitudinal, parallel support pads which are joined together, and separated by a plurality of respective hinge regions. When the pad is used as a seat support and/or back support, it may be as a single thickness or folded over in a multiple thickness and interlocked by inserting one or more pads into a respective space between each pad, thereby stabilizing the pad array. The pad may have an attachment section such as hook and loop fastener material connected at each end to secure the pad to the seat or seat back, or both, and this enables use of the pad in both areas of the seat.

10 Claims, 1 Drawing Sheet

ADJUSTABLE SEAT AND BACK SUPPORT PAD, AND MATTRESS

BACKGROUND OF THE INVENTION

This invention relates to a new and improved seating pad, and to a seating pad particularly useful with car seats, and as a mattress. Typically, chairs and seats particularly car seats allow very little room for user flexibility, even when the seat is made adjustable. Consequently, in order to render a seat more comfortable, users have employed various types of pads, pillows, etc. However, a long term and cramped seating position can lead to back problems, and hence it would be desirable to provide a seating support which is not only adjustable, but also will provide both a seating and back support, if desired.

Numerous types of seating pads and back supports are described in: U.S. Pat. Nos. 1,730,771; 1,753,359; 2,060,298; 2,745,473; 2,812,804; 3,279,849; 4,161,337; 4,666,748; 4,754,511; 4,759,543; 4,798,414; 4,924,541; 4,945,591; and, British Patents 19,409 (1898); and, 6,100 (1902).

Many of the above patents disclose pads which are too complex to manufacture, and other patents disclose pads which do not provide stability either for seating or for a back support. It would be desirable to provide not only a relatively simple seat and back support pad suitable for a car seat, but also to provide a support pad which is stable when the user moves while seated.

Also, if a pad adjustment is necessary due to a change by the user, or if a different user requires a new positioning of the pad, it would be desirable to easily make this type of adjustment. In addition, such a seat pad could also function as a mattress if it was of sufficient length.

THE INVENTION

According to the invention, there is provided a flexible, adjustable seat and back support or recliner pad which may be folded and interlocked to maintain a stable configuration during use. The adjustable pad comprises a plurality of longitudinal spaced-apart, resilient support pads separated by hinge regions to form a pad array. When folded together, the pad array may be stabilized by interlocking individual support pads into the respective spaces between pads, and this will prevent shifting of the pad during use. The pad array can also be utilized in a flat configuration, and may also function as a mattress, and for this purpose, the mattress can also be folded at its head portion to provide a head rest.

The user can thereby adjust the degree of support needed for a particular situation in which the pad array is used by adjusting the pad array height or thickness by folding over the pad array components at the required hinge regions. The folded over pad array is stabilized by interlocking individual support pads into respective adjacent spaces between the support pads. The stability of the folded over pad array is further enhanced during use since when pressure is applied to the array, this will cause the support pads to interlock even more firmly into their respective adjacent spaces. Additional stabilization of the folded over array may be accomplished by using hook and loops, fasteners, laces, snaps, etc.

Typically, the pad array may be formed by two superposed lengths of covering material which are subdivided by means of stitching, bonding, etc., to form hinge regions and parallel compartments or spaces which may be filled with support material to produce a plurality of support pads which form a pad array.

Alternatively, the pad array may be formed by joining each individually manufactured support pad to an adjacent pad at the hinge region by sewing, bonding, hook and loop tape, tape, etc. This permits replacement of one or more worn pads by removal of the worn pads from the array and replacing them. Alternatively, the remaining less worn pads can simply be reattached to form a smaller support pad, but without the worn components.

An individual support pad in the array may be formed entirely of a foam or cloth material. Alternatively, it may be formed of an outer covering material such as cloth, rubber, leather, or a plastic covering such as vinyl, or an elastomer material, and filled with a support material such as solid or pelletized foam, fiber, cotton, gauze, shredded cloth, air, water, gel, etc., or it may be partially filled, or simply unfilled. The support material may also be formed into tubes which can be inserted into each end of an individual support pad, or it can be inserted into alternate support pads, etc. Insertion of a fill material can be accomplished by means of for example, an end flap or slit formed on one or more of the support pad ends.

By making the fill material removably insertable, the user can better adjust the degree of height, thickness or support for a particular use and maintain the self stabilizing features of the pad array, supra. The pads in the array may be constructed of the same or different materials.

An individual support pad may be round, oval, square, rectangular, wedge-shaped, etc., to facilitate insertion and interlocking in the space between support pads, and to effect stabilization of the support pad array when it is folded. If desired, each end of the pad array may include hook and loop fastener material strips, or straps, loops, etc., which attach to the seat and back portions of a car seat. The support pad may also be folded over on itself and be further stabilized by attaching the end strips of hook and loop fastener material to each other.

If desired, a heating or cooling gel or gel pack may be used within a pad, or in the space between the pads, and this would also apply to the use of vibrating devices.

IN THE DRAWINGS

FIG. 1 an external, perspective view of the support pad of this invention as a single layer, flat configuration;

FIG. 2 is a plan view of FIG. 1; and,

FIGS. 3, 4, 5 and, 6 are external, views in side elevation showing the support pad of this invention installed on a seat in various configurations.

DESCRIPTION OF THE PREFERRED EMBODIMENTS

Figure 1:
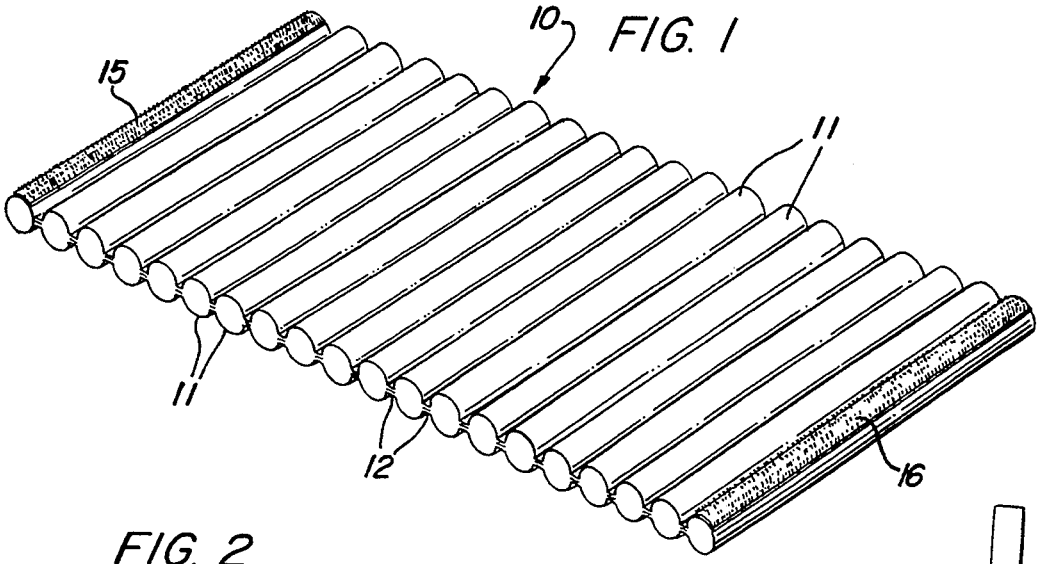
Figure 2:
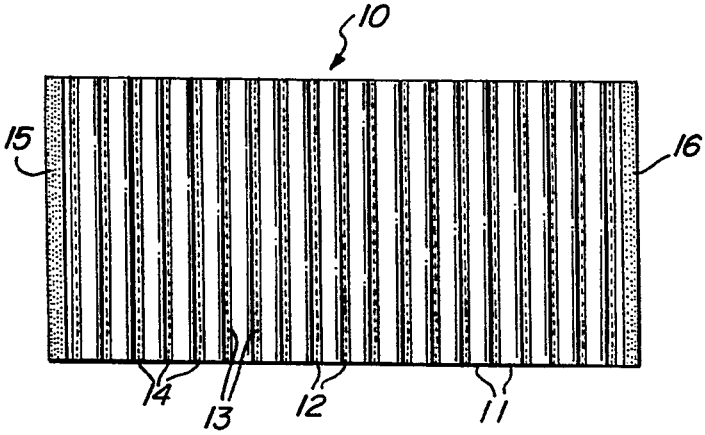
Figure 3:
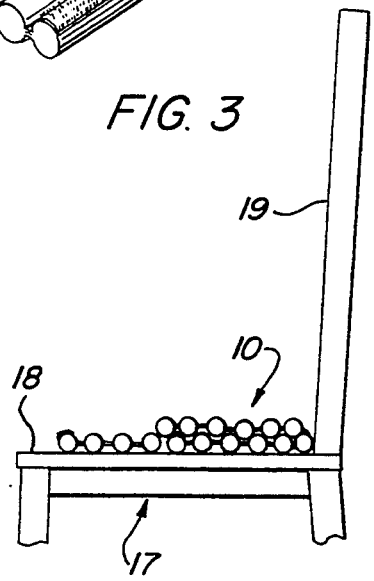
Figure 4:
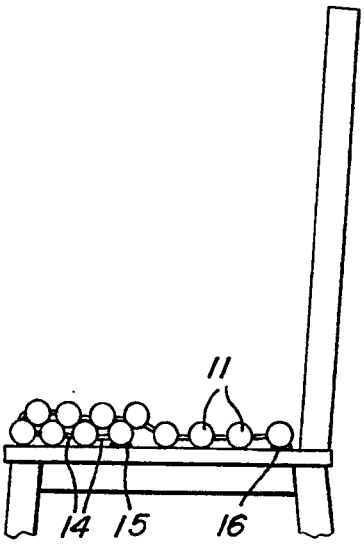

The support pad 10 of this invention is shown in FIGS. 1 and 2, and comprises an array of individual pads 11 having a parallel, rounded configuration. In the embodiment shown, the pads are separated by hinge regions 12 thereby forming a plurality of gaps 14 between the pads 11. The hinge region 12 may be formed by one or more stitch lines 13 across the width of the pad array. Alternatively, hook and loop fastener material attached to the sides of the individual support pads 11 may form the hinge region while holding the individual pads together in the pad array.

When individual pads become worn they may be replaced by removing them along a hinge region 12 for replacement with a new pad, or by reattaching adjacent pads to form a shorter support pad.

If an overlapping covering material is employed, then the spacing between individual pads and the hinge region or regions are formed when the pad array is manufactured by subdividing the material to produce the support pads.

The gaps or spaces 14 between individual pads 11, permit the insertion and interlocking of pads into adjacent gaps to stabilize the support pad and maintain its position during use, as shown in FIGS. 3–6.

FIG. 2 shows end strips 15 and 16 of hook and loop fastener material which are sewn or bonded to the support pad and which attach to a seat 17 at its bottom 18 or back 19. As indicated, supra, if used in a folded over arrangement, the strips of hook and loop fastener material at the ends of the pad array can be joined together to stabilize the support pad.

As shown in FIGS. 3–6, various aspects of a user's seating position may be supported by the support pad 10. For example, in FIG. 3, the support pad is configured to support the user's rear thighs, while in FIG. 4, the forward portion of the thighs are supported.

Figure 5:
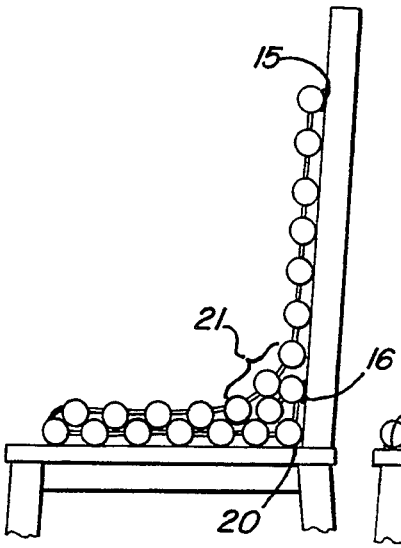

FIG. 5 shows the support pad 10 doubled over to provide moderate seating elevation for the user as well as a back support. In addition, to reduce the possibility of a user being seated in a cramped position in the junction 20 between the bottom and back of the seat, the support pad is configured to provide a smooth transition area 21 at the junction.

Figure 6:
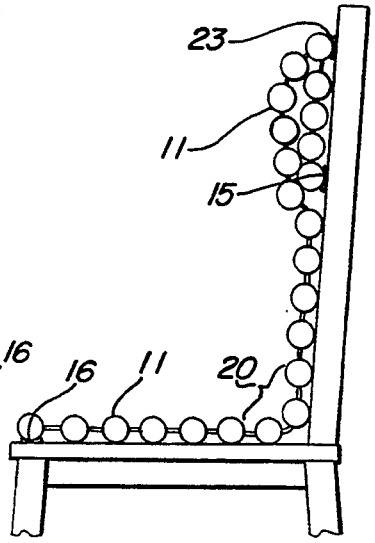

In FIG. 6, the shape of transition area 22 at junction 20 can be varied, compared to FIG. 5, but also strips 15 and 23 of hook and loop fastener material can be used together with interlocking individual pad elements to provide added support for the upper back.

If desired, the support pad may be employed solely as a back or lumbar support while maintaining the properties, as described, supra. FIG. 6 also shows the support pad being used in a single thickness to provide elevated seating for the user, but with less elevation when compared to FIG. 5.

Typically, when used as a seating pad or recliner support, the width will vary from about 12 inches to 4 feet, the length will vary from about 4 inches to 4 feet, and individual pad elements 11 are about ½-3 inches in diameter. When used as a mattress, the length of the support pad 10 will vary from about 4–7 feet, while the width of the support pad and the pad element dimensions remain the same.

The fewest number of individual pads in a pad array which may be used can vary from about 2–4; typically, the number of pads in a seating pad array may vary from about 4–60; and, in a mattress, the number of pads in an array can vary from about 60–150.

The stiffness of hinge regions 12 can be varied, depending on usage requirements and hence, if support pad 10 is used primarily as a back support, a greater stiffness of hinge region 12 may be desirable. But, if the pad 10 is used mainly as a seating support, and to form a better curvature at the junction 20, a hinge having greater flexibility may prove more useful.

It will be appreciated that hinge regions 12 may function as joining regions to join individual pad elements by means of bonding, hook and loops, etc. Added stabilization of the support pad array can be achieved by means other than strips, of hook and loop fastener material such as with zippers, buttons, laces, interconnecting end flaps, snap fasteners, and so forth.

In short, the support pad of this invention is a simple and inexpensive device which can be oriented to provide a wide variety of configurations that can be changed to accommodate the needs of different individuals and a wide variety of seating structures. Also, worn pads can be replaced with new pads, or the worn pads can be easily removed without being replaced.

I claim:

1. An adjustable support for seats, chairs, mattresses, and the like, comprising:

a.) a base portion providing an array of resilient, longitudinal, parallel support pads, a support pad being constructed of an outer covering material selected from the class consisting of cloth, rubber, leather, plastic, vinyl and elastomer, and wholly or partially filled with a material selected from the class consisting of solid or pelletized foam, fiber, cotton, gauze, shredded cloth, air water and a heating gel or a cooling gel, each pad defining a resiliently deformable and flexible support space therebetween, a support pad being sized to produce a non-congruent fit between adjacent pads of a corresponding support space in the absence of added weight or pressure, each support pad comprising a material for imparting resilient deformability thereto, each support space including a flexible hinge region, the base portion and support pads being adapted for use in a single thickness as a support element;

b.) the base portion and array being adapted for non-stabilized folding over at the hinge region into multiple thicknesses, and for stabilization into a unitary support by a resiliently deformable insertion and, subsequent conformation and interlocking of individual support pads into their respective, adjacent support spaces by weight or pressure being applied to the support pads by a user, or by hooks and loops, fasteners, snaps, and the like, thereby compressing a support pad into an adjacent support space to secure the support pads into interlocking contact within the support spaces and preventing shifting of the pad during use; and, c.) the support pads are resiliently and deformably retractable from their respective adjacent support spaces, to readjust the support to its single thickness.

2. The adjustable support of claim 1, in which the support pads and hinge regions are integrally formed on the base portion.

3. The adjustable support of claim 1, in which the support pads are mounted on the base portion.

4. The adjustable support of claim 3, in which a support pad is joined to an adjacent pad by means including sewing and bonding.

5. The adjustable support of claim 1, comprising a support pads are about ½-3 inches in diameter.

6. The adjustable support of claim 1, comprising attachment means of hooks and loops at each end of the base portion.

7. The adjustable support of claim 1, in which the support pads are about ½3 inches in diameter.

8. The support of claim 1, in which the number of pads in a pad array vary from 2–4.

9. The support of claim 1, in which the number of pads in a pad array vary from 4–60.

10. An assembly of a chair and an adjustable support, the chair providing an upright back and a horizontal seat portion defining a space therebetween, the support comprising:

a.) a base portion providing an array of longitudinal, parallel support pads, each pad comprising a material for imparting resilient deformability thereto, each pad defining a resiliently deformable support space therebetween, a support pad being sized to produce a non-congruent fit between adjacent pads of a corresponding support space in the absence of added weight or pressure, each support space including a flexible hinge region, the base portion and support pads being adapted for use in a single thickness as a support element; and, b.) the base portion and array being adapted for non-stabilized folding over at the hinge region into multiple thicknesses, and for stabilization into a unitary support by a resiliently deformable insertion, and subsequent conformation and interlocking of individual support pads into respective, adjacent support spaces by weight or pressure applied to the support pads by a user, or by fasteners, hooks and loops, laces, snaps, and the like thereby compressing the support pads into adjacent support spaces to secure the support pads into stable interlocking contact within the support spaces and preventing the pad from shifting during use; whereby, the base portion and array of support pads are reformable to the single thickness of the support by a resiliently deformable retraction of the pads from the support spaces; and, the support pad is adapted for a resilient and deformable interlocking in an adjacent support space to impart a stable, adjustable, smooth transition in the space between the back and seat portion of the chair and a stable, adjustable, back and seat support for a user attention to these matters is gratefully acknowledged.

* * * * *